US005156193A

United States Patent [19]

Baruffato et al.

[11] Patent Number: 5,156,193

[45] Date of Patent: Oct. 20, 1992

[54] METHOD FOR FILLING CONTAINERS WITH LIQUID, GELATINOUS, CORROSIVE, AND/OR STICKY PRODUCTS, OR ABRASIVE SUSPENSIONS

[75] Inventors: Roberto Baruffato, San Lazzaro; Gianfranco Salmi, Casalecchio Di R., both of Italy

[73] Assignee: Farmomac S.r.l., Bologna, Italy

[21] Appl. No.: 605,840

[22] Filed: Oct. 30, 1990

[30] Foreign Application Priority Data

Nov. 23, 1989 [IT] Italy ..... 3722 A/89

[51] Int. Cl.[5] ..... B65B 3/28; B65B 3/04

[52] U.S. Cl. ..... 141/1; 141/9; 141/83; 141/103

[58] Field of Search ..... 141/1, 9, 4, 5, 83, 141/103, 94

[56] References Cited

U.S. PATENT DOCUMENTS

| | | | |
|---|---|---|---|
| 2,925,835 | 2/1960 | Mojonnier et al. | 141/83 |
| 4,494,582 | 1/1985 | Meyer | 141/9 |
| 4,570,822 | 7/1986 | Procacino | 222/14 |
| 4,676,282 | 6/1987 | Bellini et al. | 141/1 |
| 4,696,329 | 9/1987 | Izzi | 141/1 |
| 4,745,953 | 5/1988 | Kobayashi et al. | 141/1 |
| 4,913,198 | 4/1990 | Hayahara et al. | 141/83 |
| 4,922,975 | 5/1990 | Polnschegg | 141/104 |
| 5,029,622 | 7/1991 | Mutter | 141/4 |

FOREIGN PATENT DOCUMENTS

| | | |
|---|---|---|
| 4446485 | 6/1984 | Australia . |
| 901407 | 6/1985 | Belgium . |

*Primary Examiner*—Ernest G. Cusick
*Attorney, Agent, or Firm*—Darby & Darby

[57] ABSTRACT

The method provides for weighing, in a first weighing station the tare of a container, filling, in a supply station, such container with products, particularly liquid and/or gelatinous, or corrosive, or sticky products, or abrasive suspensions, etc., again weighing, in a second weighing station, the filled container, processing data coming from said weighing stations and data concerning the pressure and temperature of the products supplied, in order to determine a time of supply required for filling a subsequent container with a rated net weight of products within predetermined tolerances.

2 Claims, 2 Drawing Sheets

PN+aPN
PN
PN-bPN
A
B
C
D
E
F
G
H 1
2
2a
3
3a
4
5
5a
6
7
7a
8
9
10
10a
11
12
12a
13
14
14a
15
16
17
18
19
20
K1
K2

METHOD FOR FILLING CONTAINERS WITH LIQUID, GELATINOUS, CORROSIVE, AND/OR STICKY PRODUCTS, OR ABRASIVE SUSPENSIONS

BACKGROUND OF THE INVENTION

This invention relates to the filling of containers (e.g. small bottles) with products, particularly semifluid and pasty liquids, or liquid and/or gelatinous solutions, sticky products, corrosive products, and abrasive suspensions (e.g. products of perfume, cosmetic, chemical and pharmaceutical industry, etc.), and also concerning, in particular, the methods and the equipment to carry out such filling.

DESCRIPTION OF THE PRIOR ART

According to the regulations in force in various countries, a predetermined rated net weight must be complied within predetermined tolerance when containers are filled with products, particularly semifluid and pasty liquids, or liquid and/or gelatinous solutions, sticky products, corrosive products, or abrasive suspensions (e.g. products of perfume, cosmetic, chemical and pharmaceutical industry, etc.).

One of the known methods provides for predetermining a constant volume of products which, knowing the relative density, corresponds to the rated net weight. In this method the calculated volume of the products is injected into the container through supply means (e.g. nozzles).

The control of the constancy of such volume is carried out by means of at least two weighings of the container, before filling (tare) and after filling (gross weight). The relative data are processed by a central data processing unit which determines the real net weight, from which, knowing the density, the corresponding value of volume is determined.

In a known solution, supplying-compensating means, located after the balance for measuring the gross weight, as used to inject a further quantity of product into the container in the case that the net weight turns out to be below the rated net weight. Such additional quantity may be constant or proportional with respect to the error detected, so to comply with the regulations in force.

However, a final weighing is not provided, after the supplying-compensating means, to certify the real weight of the product inside the container.

Furthermore, a solution is also known, which provides for varying said volume as a function of the difference between the measured net weight and the rated net weight.

The above-mentioned method is negatively affected by the wear of the product supplying means, and feeding means associated therewith, and by variations of temperature.

As a matter of fact, if for the first factor it is possible to resort to the technical solutions mentioned above (variation of volume, injection of a further quantity of products through the supplying-compensating means), the drawbacks due to temperature variations are very hard to cope with, particularly in the case of those products (e.g. cosmetics, gelatinous products) whose density is heavily affected (not always in a linear way) by temperature.

A further known method provides for the filling of containers up to a predetermined level. This does not ensure the constancy of the real weight supplied with the varying of the section of said containers.

To carry out such method, a special supplying nozzle is used, which is provided with auxiliary suction holes operating in proximity of said level, thus being designed to control the latter.

Another known method provides, in the order, for positioning the container on a balance, for weighing the tare, and for the subsequent supply of products which is carried out in two steps, quick and coarse first (with the aim of injecting as much product as possible into the container), and then slower, so to allow the rated net weight to be achieved, within the tolerance limits.

The equipment for carrying out such method consists of a balance—supplying means—hopper group, with relative electric and/or pneumatic controls, or of more groups arranged in a roundabout assembly.

The time required for weighing the tare, and for carrying out both supplying steps, affects the productivity of the method just described above quite heavily. Furthermore, the equipment carrying out such method is relatively complex.

A further known method provides for supplying the products, into the container, for a predetermined time. Thus assuming temperature and pressure being constant, the delivery of supplied product turns out to be constant, and thus the weight of supplied products is proportional to the time of supply.

The equipment for carrying out the method is extremely simple. As a matter of fact, it basically consists of a tank filled with products, on which surface a suitable pressure is applied by means of gas. At least one feeding duct ended with a nozzle branches off the tank. It is provided with an electric or pneumatic-control on-off valve, which is actuated by a timer for said time. This is not a particularly complex technical solution.

For small batches (i.e. in the case of rated net weights supplied well below the weight of products corresponding to the tank capacity), the head decrease in the same tank (in this case not provided with feeding means) brings about acceptable variations of the supply pressure, and thus it is sufficient to increase the time of supply at predetermined intervals.

In other solutions, the tank level is kept within an allowable fluctuation range, with consequent acceptable variations of the supply pressure according to the given tolerances concerning the weight of the supplied products.

The precision of this method is inversely proportional to the delivery, i.e. directly proportional to the above mentioned time of supply, obviously at equal supply pressure and temperature of the product supplied.

The method just mentioned above (also known as time/pressure method) turns out to be simple, flexible, but not thoroughly reliable, since there is no control of product temperature, of supply pressure, of the time of actuation of on-off valves, of the real weight injected into the containers.

Further methods are known, which are different from the above-mentioned methods.

In the Belgian Patent No. 901.407, there is a description of a "Process and equipment for the accurate filling of containers".

Such process involves:

positioning an empty container in a first weighing station, weighing the tare of the container and sending the data concerning the tare weight to a data processing unit;

transferring the container to the initial filling station and supplying the product into the container up to 90% of the rated net weight;

transferring the container, so partially filled, to a second weighing station with measurement of the gross weight of such container and sending the relative data to said data processing unit;

transferring the partially filled container to the final filling station, with completion of the filling through an additional supply of a batch of product, as determined by the data processing unit, suited to achieve said rated net weight with this latter supply being carried out by means of a constant-delivery pump.

The method just mentioned above does not involve any control of the additional batch of product supplied, thus any variations of the pump delivery as well as of the actuating time of the pump cannot be compensated in any way.

Italian Patent No. 3546A/87 shows a "Process and equipment for net-weight dosage through subsequent corrective supplies according to weighing controls".

Such a process involves the transferring of containers through subsequent supply stations alternated with weighing stations.

In every supply station an additional or corrective supply is carried out according to the weighing control performed in the weighing stations.

The deliveries in the supply stations are gradually decreasing. Furthermore in the last supply station an additional or a subtractive correction is performed, depending on whether the batch weight is below or exceeds the rated weight.

The equipment for carrying out this latter process requires a series of weighing stations, a series of supplying means, correspondingly alternated with the weighing stations, and a series of bridges, each of which connects two subsequent weighing stations. Thus, the mechanical and electronic features are quite complex as compared to the kinds of equipment mentioned previously, particularly as compared to the equipment carrying out the so-called time/pressure method.

SUMMARY OF THE INVENTION

An object of the present invention concerns a method showing the same positive features of simplicity and flexibility as the time/pressure method, while at the same time overcoming the drawbacks of the latter method.

Another object of the invention is to present a method in which the product supply time results from the difference between the container gross weight and the tare of the container, as well as from temperature and product supply pressure.

A further object of the invention is to present a machine, designed to carry out the above mentioned method, which can be realized by a simple, functional and reliable mechanical system, helped by a data processing unit for controlling and managing the method, in order to obtain a high productivity and an easy change of size.

The above-mentioned objects are achieved in accordance with what is described in the claims, by means of a method for filling containers with liquid and/or gelatinous, and/or corrosive, or sticky products, or abrasive suspensions, said method being carried out by means of a machine comprising:

at least one supply station of said products including a nozzle connected, by interposition of intercepting means such as a valve or, with a tank fed with said products and with gas acting on the surface of said products, a central data processing unit acting on said intercepting means;

a first and a second weighing station, electrically connected to said data processing unit;

means for measuring the level of products in said tank and means for measuring the pressure of said gas and means for measuring the temperature of the products supplied, all these means being electrically connectet with said central data processing unit; said method comprising the following steps:

transferring an empty container to said first weighing station, weighing of the tare of the container and sending relative data to said central data processing unit;

transferring said container to said supply station, and subsequent actuation of said intercepting means which can be a valve for a time of supply determined by said central data processing unit with consequent filling of said container;

transferring said container, already filled, to said second weighing station with weighing of said filled container and sending relative data to said central data processing unit;

processing, through said central data processing unit, said data, coming from said weighing stations and from said measuring means, concerning the value of the level of products in said tank, the pressure of said gas and the temperature of said products in the tank respectively, in order to determine a time of supply required for filling a subsequent container with a net weight of products within predetermined tolerances determined with respect to a prefixed rated net weight.

Furthermore a machine is described, for filling containers with liquid and/or gelatinous, and/or corrosive, or sticky products, or abrasive suspensions, said machine comprising:

at least one supply station of said products including a nozzle connected, by interposition of intercepting means, with a tank fed with said products and with gas acting on the surface of said products;

a conveyor for transferring empty containers from a distributor of such empty containers to said supply station and from said supply station to a group for packaging containers filled with said products;

means for measuring the pressure of said gas;

means for measuring the temperature of the products supplied;

a first weighing station, associated with said conveyor above the supply station, for weighing the tare of said container;

a second weighing station associated with said conveyor below said supply station, for weighing the gross weight of said container filled with said products;

a central data processing unit electrically connected with said weighing stations, said measuring means, and said intercepting means, said central data processing unit being designed to process data coming from said weighing stations and from said measuring means and to actuate said intercepting means for a time of supply defining the filling, in said supply station of a subsequent container with a net weight of products within predetermined tolerances determined with respect to a prefixed rated net weight.

BRIEF DESCRIPTION OF THE DRAWINGS

The features of the invention are pointed out here below, with particular reference to the drawings enclosed herewith, where.

DESCRIPTION OF THE PREFERRED EMBODIMENT

Figures 1, 2:
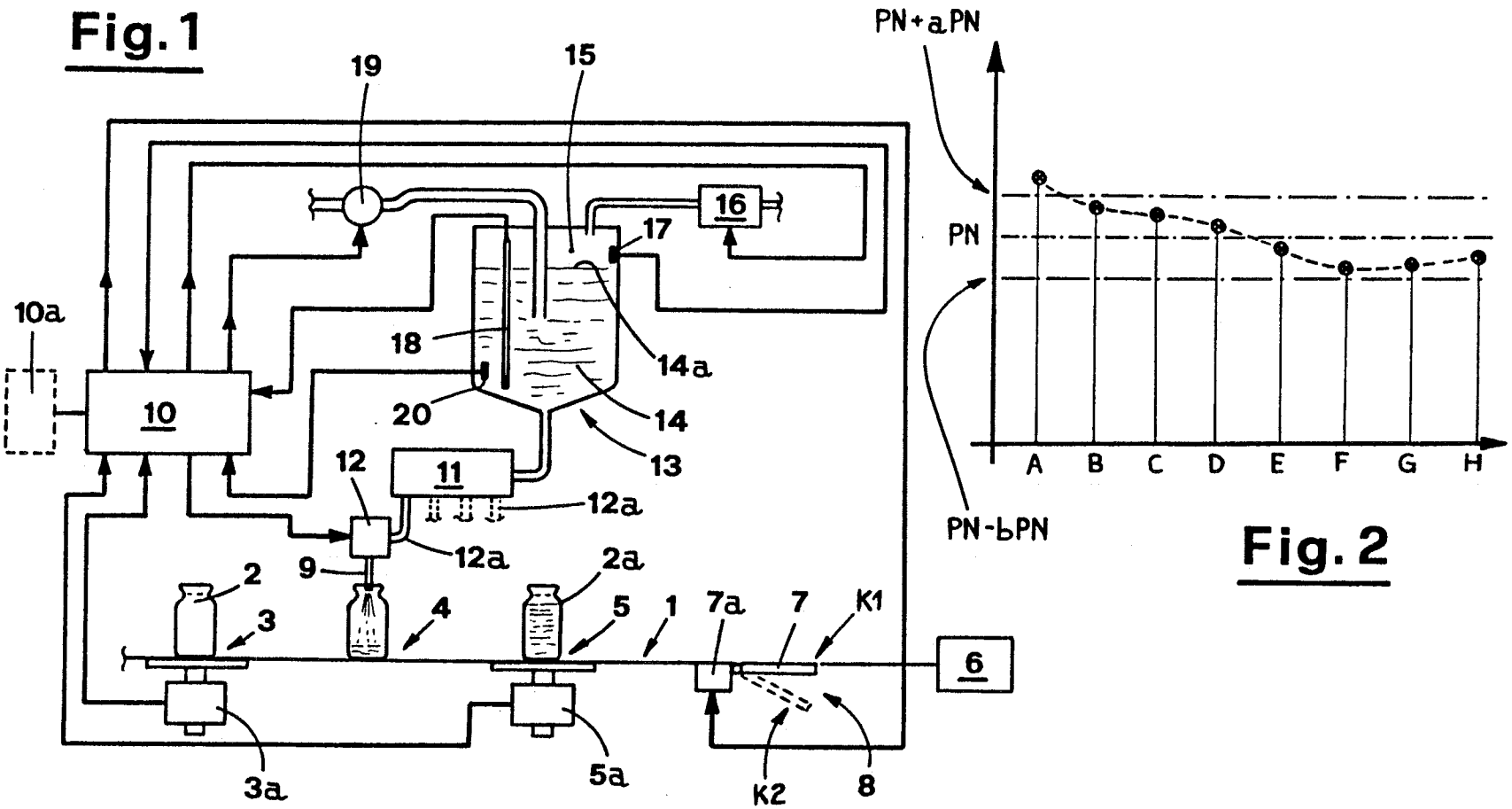
FIG. 1 shows schematically, and by block diagrammatic form, a first embodiment of the machine for carrying out the method concerned by the invention.
FIG. 2 shows a diagram meant to help the understanding the above-mentioned method.

With reference to FIG. 1, reference numeral 1 generically indicates a feeding conveyor which functions, according to known techniques, is to receive an intermittent or continuous flow of empty containers 2 (e.g. small bottles) coming from a suitable distributor (not illustrated), to transfer them subsequently, in the order, to a first weighing station 3, to a supply station 4, for filling the small bottles, to a second weighing station 5 for weighing the filled bottles 2*a*, and finally to a group 6 for packaging the filled bottles 2*a*.

Before the packaging group 6 there are located deflecting means 7 of a known type, associated with the conveyor 1, made movable, by means of corresponding actuators 7*a*, between two extreme positions, the rest position K1 and the operating position K2, respectively.

In the rest position K1 the containers 2*a* can be transferred towards the packaging group, while in the operating position K2 the containers 2*a* are addressed towards a discharge station 8.

The actuators 7*a* are controlled by a central data processing unit, generically identified by the reference 10.

The first and second weighing stations 3 and 5 are provided with known electronic means, identified by 3*a* and 5*a*, respectively, for recording the weight; and such means are electrically connected with the central data processing unit 10.

In the supply station 4 a nozzle 9 is provided, fed by a distributor 11 subject to the action of interposed intercepting means 12 (e.g. a valve which can be opened and closed of the type involving the compression of the duct 12*a* feeding said nozzle) controlled by the unit 10; the distributor 11 (which may feed a series of ducts 12*a*) is, in turn, fed by a tank 13.

Such tank is partially filled with products 14 (semi-fluid and pasty liquids, liquid and/or gelatinous solutions, or corrosive products, or sticky products, or abrasive suspensions, etc.), e.g. relative to the perfume, cosmetic, chemical-pharmaceutical industry, etc.

The free surface 14*a* of the products 14 is subjected to the pressure of gas 15 (it is to be pointed out that for pasty products the air of a pressing means is necessary); suitable means 16, controlled by the unit 10, are provided for regulating the value of pressure, in particular to keep it constant, in accordance with the measurement of the pressure carried out through measuring means 17 (electrically connected with the unit 10).

The level of the products 14 inside the tank is measured through measuring means 18 electrically connected with the unit 10; and according to the measurement the unit 10 operates means 19 for feeding the tank 13 with the products 14 to keep their level inside the tank, constant.

The temperature of the products 14 inside the tank is measured by measuring means 20 electrically connected with the unit 10.

Knowing the type of products 14 it is possible, knowing also the temperature, to determine the value of density of such products, hence the specific weight, and, consequently, the share of pressure of the products 14, in proximity of the outlet of the nozzle 9, generated by the "head" of such products in the tank 13.

The remaining share of the supply pressure is generated by the action of said gas pressing, as it was mentioned above, directly or through a pressing means, on the free surface 14*a* of the products 14 contained by the tank.

The central data processing unit 10, by processing the data concerning the level of products in the tank, the pressure of the gas acting on the products surface and the temperature of these products, is able to determine the value of the supply pressure in proximity of the outlet of the nozzle 9.

The supply pressure being known, the unit 10, according to a pre-fixed rated net weight PN of liquid (whose relative data are put, in a known way, into the unit 10 or have been previously stored in the same unit) and according to the nozzle diameter, determines the time of supply, i.e. the actuating time of the intercepting means 12, this being the time that its valve remains open.

The phases of the method proposed are described here below.

By means of the conveyor 1, an empty container 2 is transferred to the first weighing station 3 which electronic means 3*a* provide for sending the data, relative to the tare, to the unit 10.

Subsequently, the empty container 2 is transferred to the supply station 4 where, in a basically known way (not illustrated), the nozzle 9 is coupled with the container neck; at this point the intercepting means 12 are actuated for an interval of time equal to said time of supply.

The container 2*a* filled with said products 14 is then transferred to the second weighing station 5 whose electronic means 5*a* provide for sending the data, concerning the gross weight of the container 2*a*, to the unit 10.

The unit 10 checks, in real time, the net weight of the products injected into the container, and if such net weight is comprised within the tolerance band PN+aPN, PN−bPN, (a,b may be of equal value), where PN is the rated net weight.

If the net weight is not within the tolerance band (as in the case of the container identified by A in the diagram of FIG. 2), the unit 10 provides for actuating the actuators 7 *a*. In that case the filled container 2*a*, through the deflecting means 7, is addressed towards the discharge station 8.

Otherwise, the full container 2*a* is transferred to the bottle packaging group 6.

The unit 10 processes the data relative to the net weight of products injected into the container, and, according to such data, together with the data relative to the head of products in the tank, to the value of gas pressure and to the value of temperature of the products contained by the tank, it provides, if necessary, for modifying the time of supply so to bring back, according to circumstances (as in the case of the container identified by A) or to keep (as in the case of the containers identified by B,C,D,E,F,G,H,) the net weight supplied within the predetermined tolerance band.

In practice, by the present method it is possible to regulate the time of supply as a function of the actual trend of real net weights: e.g. the trend of the containers B,C,D,E,F is to bring the net weight below the lower limit of the tolerance band.

This is prevented by acting on the time of supply, so to reverse the trend, as it has been pointed out in terms of quality for the containers G,H.

Any variation, even a large one, of the tare of containers cannot affect the validity of the method proposed, since the "batch" supplied is determined by the unit 10 irrespective of the value of tare.

As it has been mentioned above, the unit 10 provides for regulating the value of the level of products 14 in the tank 13, and the value of pressure of the gas acting on the free surface of such products, in particular it aims at limiting the range of fluctuation of such values with respect to constant values.

Any variations of said values are received by the unit 10 with a certain delay, owing to inertia of the measuring means 20,17; this is not a drawback as far as the reliability of the method is concerned, since the unit 10 provides, in real time, for properly varying the time of supply according to the measurements carried out by the second weighing station 5 as compared to the measurements carried out by the first weighing station 3.

Any variations of the delivery of products supplied (caused, for instance, by foulings in the nozzle, or in the relative feeding duct, by variations of the losses of pressure in the distributor 11 and/or in the intercepting means 12), as well as any fluctuations of the temperature of products in the tank, do not involve variations of the net weight of the products supplied, since the unit 10 provides, in real time, for properly varying the time of supply according to the data coming from the weighing stations.

Figure 3:
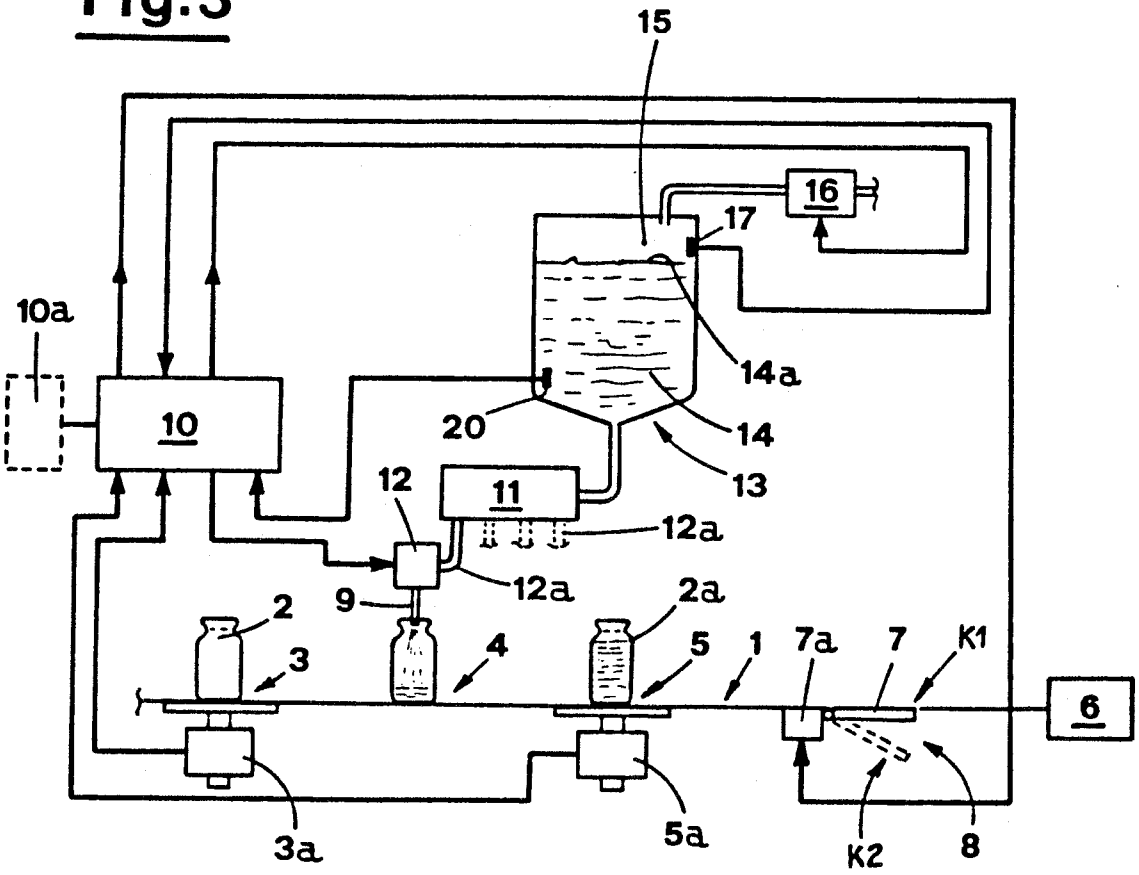
FIG. 3 shows schematically, and by block and diagrammatic form, a second embodiment of the machine for carrying out the above mentioned method.

In the case that the quantity of product supplied is much lower than the capacity of the tank 13 (thus, with one tank it is possible to carry out a working cycle), it is advisable to use the machine illustrated in FIG. 3, which is not provided, as compared to the previous embodiment, with the means 18 for measuring the level of products 14 in the tank 13, and with the means 19 for feeding the tank with said products.

The decrease of the head pressure in the tank brings about downward variations of the supply pressure; the flexibility, and the rapidity of intervention of the equipment, are such as to compensate such variations, however slow, with a progressive increase of said time of supply.

A variation of the method proposed provides for varying the section of supply of the products 14, as an alternative to varying the time of supply or in conjunction with the latter adjustment; this can be achieved by providing, instead of the intercepting means 12, or in conjunction with them, means (controlled by the unit 10) specially designed for varying the amount of supply of the products 14 such as by varying the volume and/or rate of flow.

Such a variation makes it possible to fix an upper limit for the time of supply, with consequent positive effects on productivity.

The machine for carrying out the abovementioned method is defined by the combination of means already known individually, and it allows to solve, in a way that is easy and effective at the same time, the technical problem concerning the filling of containers with a predetermined net weight of products 14, within predetermined tolerances.

Said machine keeps the typical advantages of the machines carrying out the so-called time/pressure filling method, while at the same time it eliminates the drawbacks of the known machines.

As a matter of fact, the means making up the machine, on one hand make it possible to measure at any moment the values concerning the parameters which may affect and/or modify the supply pressure and/or the density of the product supplied, and on the other hand to process, in real time, such data (and relative variations) so to intervene and adjust the time of supply properly.

The machine is realized in such a way as to provide for self-regulation when the size is changed, i.e. by a container, different from the previous one, with a corresponding rated net weight and, if necessary, a nozzle with a diameter suited to vary the delivery of the product supply, as a consequence of the input of data in the unit 10 defining said net weight.

On change of size, it is possible to use advantageously the data stored in a "menu" (or transferred into a floppy disk) relative to the operations of batching of a previous equal size.

With the unit 10, a peripheral unit **10*a* is advantageously associated, designed for displaying and/or printing all the data sent to the unit 10 (data supplied by the electronic means 3*a*, 5*a*, by the measuring means 18, 17, 20), the output of the unit 10 (data relative to the controls of the means 16, 19, 7, data relative to the actuating time of the intercepting means 12**), and finally the data relative to the processing of data concerning the differences between the real weight supplied and the rated net weight.

The analysis of said data allows, at every moment, to check the functionality of the method, as well as the functionality of the various parts of the machine, in particular detecting any "deviation" of some values with respect to the relative optimal operating values; moreover, the possibility of printing data allows them to be certified.

In conclusion, the method proposed shows the same undeniable advantages of the known time/pressure filling method, while at the same time eliminating its drawbacks.

The machine for carrying out this method turns out to be of simple realization, and shows all the advantages deriving from controlling the method through the unit 10, as well as from the control of all the means making up the same machine.

It is to be pointed out that with this machine it is possible to manage many supply stations 4, while keeping unaltered the above-mentioned advantages; this allows to achieve a very big productivity (number of containers filled in a unit of time).

It is understood that the above has been described by way of example and not as a limitation, therefore any possible variations concerning the phases of the method, or the parts of the machine carrying out such method, are to be considered as covered by the patent according to the following claims.

What is claimed is:

1. A method for filling containers with a liquid, gelatinous, corrosive, sticky, or abrasive suspension product with a machine having:

at least one supply station including a tank supplied with said product and outlet means for said tank, said tank also having gas acting on the surface of said product therein, a central data processing unit for controlling said outlet means;

a first and a second weighing station electrically connected to said data processing unit;

means for measuring the level of product in said tank, means for measuring the pressure of the gas acting upon the product in the tank, and means for measuring the temperature of the product supplied, said measuring means being electrically connected to said central data processing unit;

said method comprising the steps of:

transferring an empty container to said first weighing station and weighing the tare of the container and sending data concerning said tare of said container to said central data processing unit;

transferring said container to said at least one supply station, actuating said outlet means for a time of product supply determined by said central data processing unit to fill said container;

transferring said filled container to said second weighing station, weighing said filled container and sending data corresponding to the weight of said filled container to said central data processing unit;

processing in said central data processing unit said data from said weighing stations and from said means for measuring the level of product in said tank, the pressure of said gas and the temperature of said product so as to determine a time of supply required for filling a subsequent container with a net weight of product within predetermined tolerances determined with respect to a predetermined rated net weight.

2. A method for filling containers with a liquid, gelatinous, corrosive, sticky, or abrasive suspension product with a machine having:

at least one supply station including a tank containing said product and including outlet means for regulating the volume flow of supply of said product from said tank, said tank also having gas acting on the surface of said product therein, a central data processing unit for controlling said outlet means for regulating the volume flow supply;

a first and a second weighing station electrically connected with said central data processing unit;

means for measuring the level of product in said tank, means for measuring the pressure of said gas, and means for measuring the temperature of the product supplied, the measuring means being electrically connected to said central data processing unit; said method comprising the steps of:

transferring an empty container to said first weighing station and weighing the tare of said container and sending data concerning said tare of said container to said central data processing unit;

transferring said container to said at least one supply station;

actuating said outlet means for regulating the volume of the supply for a predetermined time determined by said central data processing unit to fill said container;

transferring said filled container to said second weighing station, weighing said filled container and sending data corresponding to the weight of said filled container to said central data processing unit;

processing in said central data processing unit said data from said weighing stations, and data from said means for measuring the level of product in said tank, the pressure of said gas and the temperature of said product so as to determine a value of the volume supply and the time required for filling a subsequent container with a net weight of product within predetermined tolerances determined with respect to a predetermined rated net weight.

* * * * *